United States Patent [19]

Lerner et al.

[11] 4,278,146

[45] Jul. 14, 1981

[54] SOUND BARRIER

[76] Inventors: Armand Lerner, 100 E. Hartsdale Ave., Hartsdale, N.Y. 10530; Sylvain S. Lerner, 301 E. 79th St., New York, N.Y. 10021

[21] Appl. No.: 79,784

[22] Filed: Sep. 28, 1979

[51] Int. Cl.[3] ..... G10K 11/04; E04B 1/84; E04B 1/99

[52] U.S. Cl. ..... 181/210; 181/289; 181/291; 181/295; 52/144

[58] Field of Search ..... 181/284–295, 181/210; 52/144–145

[56] References Cited

U.S. PATENT DOCUMENTS

| | | | |
|---|---|---|---|
| 2,007,374 | 7/1935 | Kuehne | 52/145 |
| 2,175,630 | 10/1939 | Kiesel, 3rd. | 181/284 X |
| 4,016,689 | 4/1977 | Wendt | 181/284 |
| 4,094,379 | 6/1978 | Steinberger | 181/284 |

FOREIGN PATENT DOCUMENTS

| | | | |
|---|---|---|---|
| 222770 | 8/1958 | Australia | 181/292 |

*Primary Examiner*—L. T. Hix
*Assistant Examiner*—Thomas H. Tarcza
*Attorney, Agent, or Firm*—Henry R. Lerner

[57] ABSTRACT

A sound barrier for isolating a noise source of the type emanating from manufacturing areas for food. The sound barrier comprises a panel made of sound attenuating material having a plurality of longitudinally extending side by side co-planar sections separated by V-shaped ribs so as to define a plurality of longitudinally extending side by side cavities. The cavities are provided with acoustical absorptive material therein so that the sound waves emanating from the noise source are first absorbed by the acoustical absorptive material and thereafter partly attenuated by the panel and partly deflected thereby so as to be absorbed again by the acoustical absorptive material. The panel is preferably transparent and portions of at least some cavities may be left free of acoustical absorptive material so as to provide undistorted vision from one side of the panel to the opposite side thereof. The sound barrier is intended to be disposed so that the open faces of the cavities confront the noise source.

13 Claims, 6 Drawing Figures

SOUND BARRIER

BACKGROUND OF THE INVENTION

Noise control has always been a problem in connection with industries which require FDA and/or USDA acceptance as, for example, when providing sound barriers to isolate sound emanating from manufacturing areas for food and the like.

The reason for this state of affairs is that, in order to comply with OSHA requirements for noise reduction, the type of acoustical treatment previously available was incompatible with the stringent sanitary requirements of FDA and/or USDA and such acoustical treatment was usually not economically produceable by prior art manufacturing techniques.

The most pertinent prior art sound barrier purporting to deal with these problems is that shown in U.S. Pat. No. 4,094,379 issued June 13, 1978. The barrier in accordance with this patent, however, leaves much to be desired. More specifically, the basic panel is formed of surfaces angularly related to the line of sight thus creating optical distortion when viewing through the panel. Further, the sound absorbing body forming part of the panel is mounted so as to be easily, though inadvertently, displaced or possibly broken loose. Further, such sound absorbing body forms a juncture with the panel proper so as to provide acute angles therebetween defining receptacles for easy accumulation of dirt whereby the cleaning thereof in a manner satisfactory to FDA and/or USDA requirements is rather difficult. Further, the depth of the panel, approximately 4", takes up substantial and valuable space, particularly in a retrofit situation. Further yet, the basic acoustical arrangement of said prior art patent does not provide maximum noise reduction.

SUMMARY OF THE INVENTION

In accordance with the invention, there is provided a modular sound barrier which effectively attenuates noise by means of sound transmission loss and sound absorption. The sound barrier includes a basic panel configuration whose major portions lie in a plane perpendicular to the line of sight extending from the noise source on one side of the panel to the observation point on the opposing side of the panel, thus avoiding optical distortion when viewing through those portions of the panel which are left uncovered by acoustical absorptive elements.

The panel is made of a sound attenuating material, provided with acoustical absorptive elements so that the sound waves are absorbed by the acoustical absorptive elements prior to reaching the surface of the panel sound attenuating material, whereby the remaining sound waves which are not fully absorbed by the acoustical absorptive element are deflected back through said sound absorptive element or else are attenuated by the sound attenuating material.

The panel is basically formed of flat sections separated by V-shaped ribs so as to define a plurality of side-by-side cavities which are adapted to receive acoustical absorptive material therewithin. Selected portions of the cavities may be left uncovered by acoustical absorptive material to define means through which unobstructed view can be obtained from one side of the panel to the opposite side thereof where the noise source is located.

The acoustical absorptive elements are preferably self-contained units which can easily be secured into the cavities in recessed condition, thus avoiding the possibility of inadvertently displacing or dislocating the acoustical absorptive elements. Furthermore, the panel construction is such that the ribs which interconnect the adjacent flat sections of the panel, define obtuse angles therebetween, further facilitating the cleaning operation since any dirt accumulated in the panel is easily accessible, contrary to the situation where the absorptive elements define an acute angle with their supporting panel. The acoustical absorptive material usually comprises a conventional sound absorbing foam covered by a plastic film so that the unit can be easily cleaned, does not retain soil or wash water and is self draining. The acoustical absorptive material unit is sealed within the panel by a continuous smooth non-peeling and inert caulking material.

Because of the construction of this modular panel, namely, the flat sections maintained in side-by-side relation by intermediate V-shaped ribs, the unit is free standing and can be built up in a modular fashion into a barrier of any predetermined size. Further the relative arrangement between panel and absorptive elements is such as to provide maximum noise reduction so that the panel in accordance with the invention provides a barrier far superior to that previously used and known.

DESCRIPTION OF THE PREFERRED EMBODIMENTS

Figure 1:
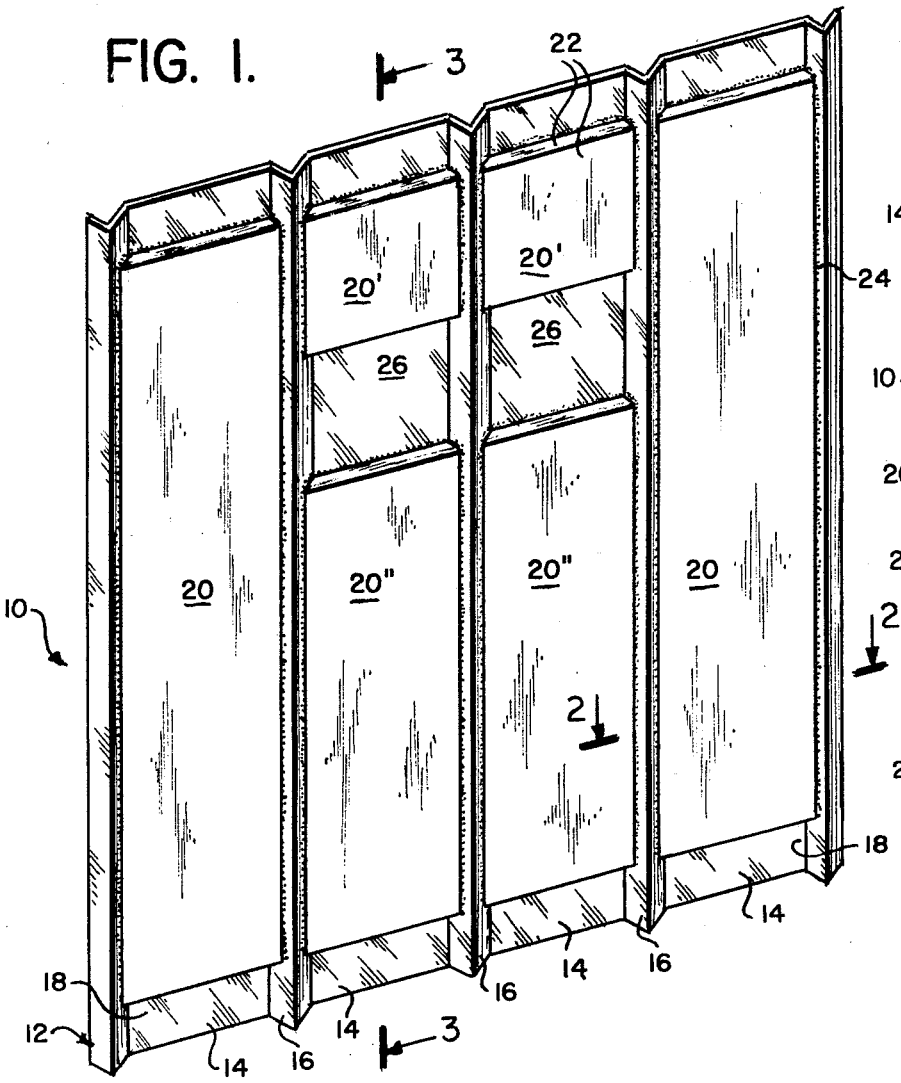
FIG. 1 is a front perspective view of the sound barrier in accordance with the invention.
Figure 3:
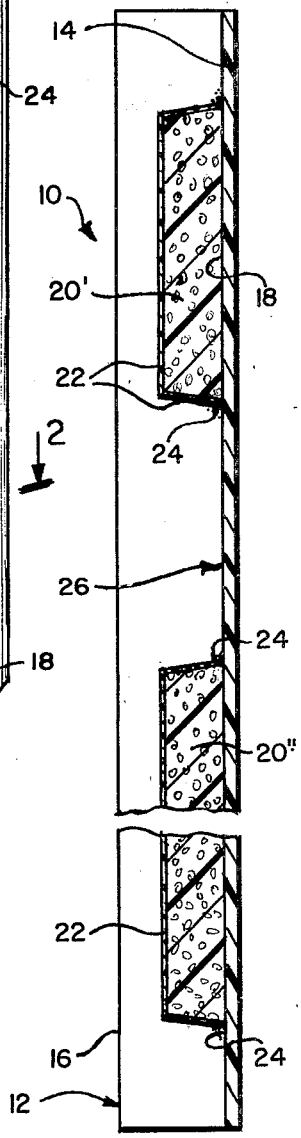
FIG. 3 is a section taken along line 3—3 of FIG. 1.
Figure 2:
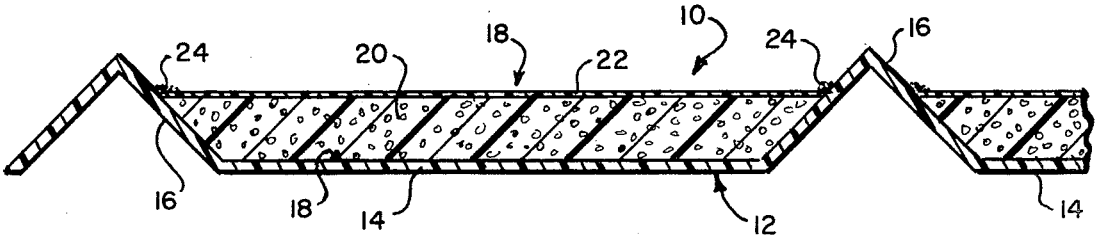
FIG. 2 is a section taken along line 2—2 of FIG. 1, showing the cross section of a typical panel portion.

Referring now to FIGS. 1, 2 and 3 of the drawings, there is shown a sound barrier 10 in accordance with the invention comprising a modular panel 12 made of transparent rigid plastic material, commercially sold as Uvex®. Panel 12 includes a series of side-by-side upstanding coplanar sections 14 separated by V-shaped ribs 16, said sections 14 cooperating with said ribs 16 to define spaced vertically extending cavities 18. Cavities 18 receive self-contained units 20 of acoustical absorptive material which may be made of cellular structural material such as plastic foam whose outer or exposed surfaces are covered by a plastic protective film 22. This film 22 serves as a membrane which permits sound waves to readily impinge upon the acoustical absorptive member 20 thereby minimizing the loss in the sound absorptive characteristics of element 20. This plastic film, when properly applied to the acoustical absorptive member 20, increases the sound absorptive characteristics of lower octave bands. The film further permits the acoustical absorptive element 20 to be easily cleaned with hot water and sanitizing solutions so as to meet FDA/USDA acceptance requirements. Elements 20 are preferably modular standard units of basically open cell low density impact absorbing and sound absorbing material so that when necessary, these can be replaced unit by unit in a simplified manner.

As shown in FIGS. 1 and 2, the acoustical absorptive material 20 fills more than half the cavity 18 but does not fill it completely so that the acoustical absorptive material is recessed within the cavity thus making it virtually impossible for such material to be inadvertently contacted. Preferably, a sealant 24 is provided for sealing the peripheral edges of the acoustical absorptive element 20, within its cavity.

When in use the sound barrier 10, in its vertically free standing condition, is positioned so that the peaks of ribs 16 (which form an included angle of approximately 90°) and the acoustical absorptive element 20 face the noise source. Viewing FIG. 2, therefore, the noise source would be located above the sound barrier with the area below the sound barrier being that intended to be acoustically insulated from said noise.

As previously stated, it is desirable to provide means for permitting viewing from one side of the sound barrier, through the sound barrier, the area which is intended to be acoustically insulated by said barrier. For such purpose, as shown in FIG. 1, portions 26 of one or more cavities 18 are left unprovided with acoustical absorptive material 20 thus defining transparent viewing portions unobstructed by the acoustical absorptive material. As previously noted, upstanding sections 14 of panel 12 are planar and in a plane perpendicular to the line of sight extending through the panel so that the vision through unobstructed portions 26 of the panel are not optically distorted as would be the case if these portions were in a plane forming an angle with the line of sight.

The viewing portion 26 is also illustrated in FIG. 3 which further shows that such viewing portion separates acoustical absorptive section 20 into upper component 20' and lower component 20''. In this connection, it will further be noted that the upper and lower edges of sections 20' and 20'' are sloped downwardly and upwardly, respectively, approximately 10° to 15°, these slopes being for the purpose of further broadening the field of vision of the area through section 26, to facilitate cleaning, and to automatically enable drainage of wash water.

It will also be noted, with particular reference to FIG. 2, that the juncture of the acoustical absorptive element 20 with panel 12, at ribs 16, is at an obtuse angle making it quite easy for the cleaning of such juncture, especially as compared to a construction wherein such juncture is defined by an acute angle.

The viewing sections 26 as well as the peaks of the ribs 16 which are not covered by acoustical absorptive material permit the transmission of light from one side of the barrier to the other.

Figure 4:
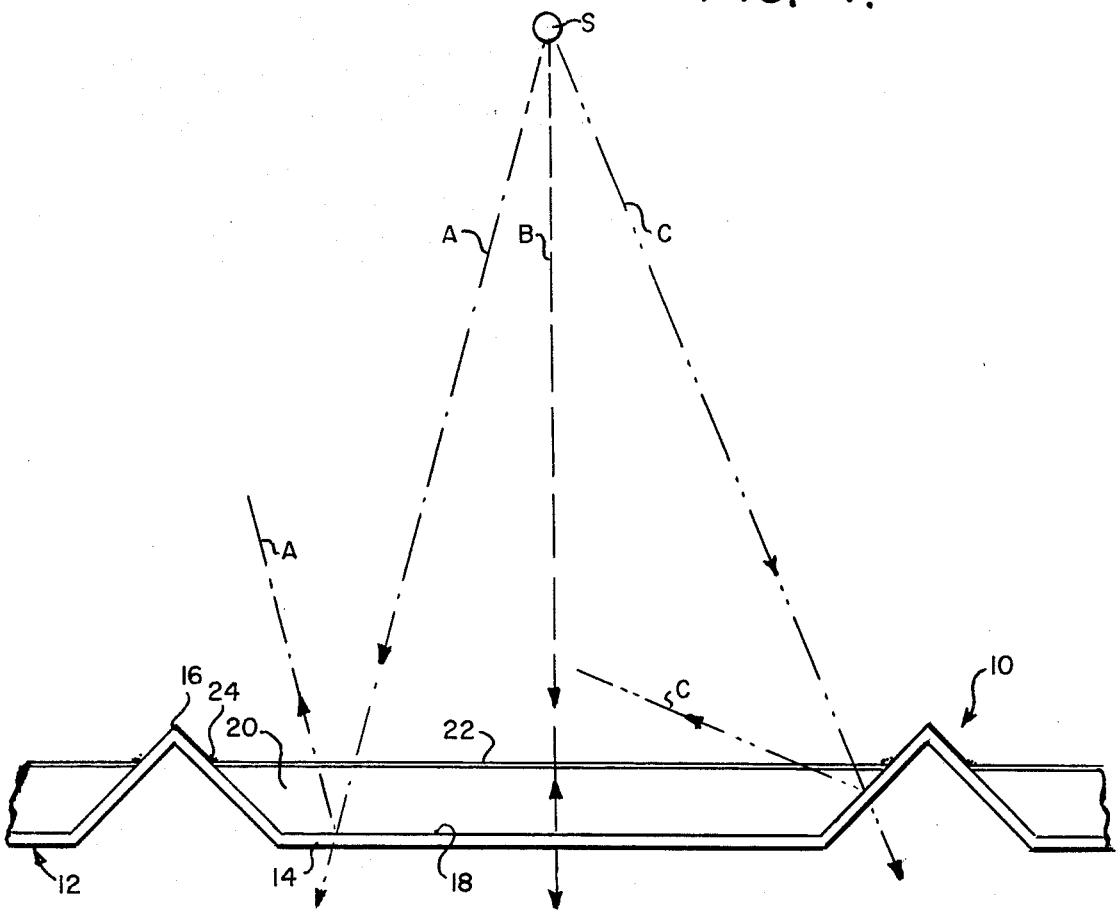
FIG. 4 is a schematic illustrating the manner in which the sound barrier in accordance with the invention absorbs and attenuates the sound waves.

FIG. 4 illustrates schematically the functioning of the sound barrier in accordance with the invention. In FIG. 4, S identifies the noise source, there being shown three separate sound waves A, B and C emanating therefrom. As to sound wave A, the same is seen to angularly impinge acoustical absorptive element 20 which absorbs a substantial portion of the wave intensity. The unabsorbed portion then proceeds and impinges upon plastic panel 14 where part thereof is reflected and thus passes through acoustical absorptive element 20 a second time, the remainder passing through panel 14 which attenuates a substantial part of the sound wave, permitting transmittal to the opposite side thereof of only a relatively small remaining portion thereof. Sound wave B emanating from noise source S impinges acoustical absorptive element 20 head on wherein it is partially absorbed with a substantial part of the remainder being reflected back towards the noise source and only a small unattenuated portion passing through panel 14. Sound wave C which is typical of only a very small portion of the emanating sound waves is seen to angularly impinge acoustical absorptive element 20 which absorbs a portion of the wave intensity. The unabsorbed portion then proceeds and impinges upon the rib of plastic panel 14 where part thereof is reflected and thus passes through acoustical absorptive element 20 a second time, the remainder passing through rib of panel 14 which attenuates a substantial part of the sound wave, permitting transmittal to the opposite side thereof of only a relatively small remaining portion thereof. Thus it is seen that the bulk of the sound waves emanating from a noise source pass through the acoustical absorptive element twice with only a very small unattenuated portion thereof passing through the opposite side of the panel, whereby a noise reduction capable of compliance with OSHA requirements may be effectuated. It will be understood that the acoustic performance of the barrier can be varied by changing the thickness of the sound absorbing foam and the dimensions of the plastic panel. In this connection, the plastic panel is contemplated as being approximately 3/16" thick and 2" deep from the tip of the rib to the back of the panel. This depth decreases the amount of required space, particularly important in a retrofit situation.

Figure 5:
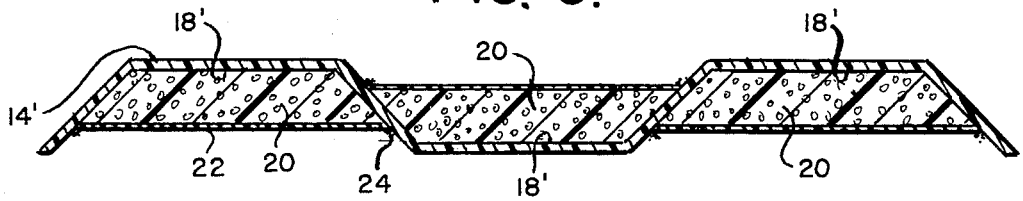
FIG. 5 is a sectional view of another embodiment of the invention.

FIG. 5 represents a modification of the sound barrier in accordance with the invention. In accordance with such modification, panel 14' is provided with cavities 18' filled with acoustical absorptive material 20 which alternately face opposite sides of the sound barrier so that sound waves from each side of the barrier can be absorbed and attenuated in a manner substantially similar to that shown in FIG. 4. The sound barrier of FIG. 5 is free standing in the same manner as that of FIGS. 1 through 4 and may also be provided with vision areas at appropriate locations on the sound barrier.

Figure 6:
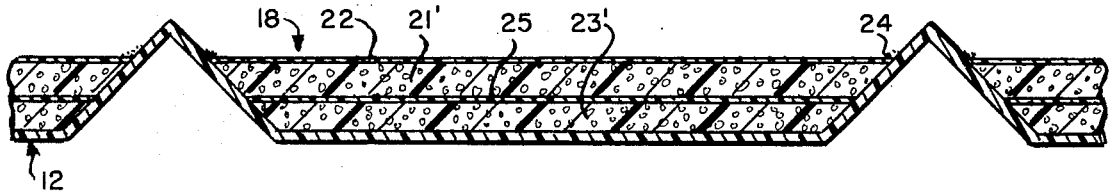
FIG. 6 is a sectional view of yet another embodiment of the invention.

FIG. 6 represents another embodiment in which the cavity 18 is provided with two separate layers of acoustical absorptive material 21' and 23', respectively, there being provided therebetween a sheet of septum material 25. This septum material 25 which is preferably a limp high density plastic sheet defines an additional sound attenuating panel for further increasing the noise reduction of the sound barrier. Another way of effectuating such further noise reduction is to increase the thickness of panel 12 and this can be done in the embodiment of FIG. 6 as well as in the embodiments of FIGS. 1 through 5.

In each embodiment of the invention, the panel is basically rigid and has a smooth surface which is parallel to the acoustical absorptive element adhered thereto. Further in each embodiment, wherever a vision area is desired for viewing or for light transmission, the cavity is left unfilled for the desired extent.

Each of the sound barriers in accordance with the invention is a self-supporting structure which can be used as a vertical partition or wall. Alternatively the sound barrier can be supported in horizontal disposition, suitably braced, with the cavities running horizontally rather than vertically. In such disposition of the sound barrier one or more cavities may be left wholly or partially unfilled with acoustical absorptive element to define in effect horizontally extending vision areas to extents as may be desired.

Any noise source may be enclosed partially or completely with suitable modular configurations of the sound barriers in accordance with the invention in order to eliminate or reduce the noise from the noise source. As has been demonstrated above, each sound barrier is essentially formed by a series of flat cavity defining sections separated by ribs which are V-shaped in the embodiment of FIGS. 1 to 3 and 6 which is slanted with respect to the embodiment of FIG. 5. Each cavity is provided with acoustical absorptive material commercially available as polyurethane foam.

The acoustical absorptive material is provided in predetermined self contained units having the sloping edges previously described and covered with the aforementioned protective film commercially known as Mylar®.

The modular units are mounted so that the cavities face the noise source so as to effectively absorb and attenuate the sound waves emitted from the noise source in the manner described in connection with FIG. 4 whereby to provide a more than satisfactory noise reduction through the absorption and attenuation functions of the sound barrier. It should also be noted that in each of the embodiments, the major surfaces of the plastic attenuating panel and the outer face of the acoustical absorptive elements within the cavities are parallel to each other and basically perpendicular to the area containing the noise source. This enables the sound waves to penetrate the absorptive acoustical material to thereby reduce the sound intensity after which the remaining sound waves are either deflected back towards the noise source, passing again through the absorptive acoustical material, with the remainder being attenuated by the panel leaving only a portion which is transmitted to the opposite side of the sound barrier.

Having thus described our invention, what we claim and desire to secure by Letters Patent is:

1. A sound barrier for isolating a noise source comprising, (a) a transparent panel made of sound attenuating material, (b) said panel comprising a plurality of longitudinally extending side by side co-planar flat sections separated by V-shaped ribs so as to define a plurality of longitudinally extending side by side cavities, said flat sections comprising the major part of said panel, (c) at least some of said cavities being provided with acoustical absorptive material therein in engagement with the entire transverse extent of the flat sections thereof, (d) said barrier being disposed so that the open faces of said cavities confront said noise source, and with the plane defined by said co-planar flat sections extending vertically.

2. A sound barrier in accordance with claim 1, wherein portions of at least some cavities are free of said acoustical absorptive material whereby to provide undistorted vision from one side of said panel to the opposite side thereof through said portions.

3. A sound barrier in accordance with claim 1, wherein said acoustical absorptive material has its exposed surface covered with a plastic film which defines a protective membrane therefor.

4. A sound barrier in accordance with claim 1, wherein the apex of said V-shaped ribs is defined by an angle of approximately ninety degrees.

5. A sound barrier in accordance with claim 1, 3 or 4, wherein said acoustical absorptive material is provided in the form of modular standard preformed units of open cell low density impact and sound absorbing material.

6. A sound barrier in accordance with claim 1, 2, 3 or 4, wherein said acoustical absorptive material fills at least half but less than all of the cavity so as to be recessed therewithin.

7. A sound barrier in accordance with claim 6, wherein the juncture of the acoustical absorptive material and the associated ribs is defined by an obtuse angle facilitating the cleaning of such juncture.

8. A sound barrier in accordance with claim 1, 2, 3 or 4, wherein said acoustical absorptive material comprises two separate layers separated by a sound attenuating septum material.

9. A sound barrier for isolating a noise source comprising, (a) a transparent panel made of sound attenuating material, (b) said panel comprising staggered side by side parallel spaced co-planar flat sections interconnected by angular sidewalls so as to define side by side cavities alternately facing opposite sides of said panel, said flat sections comprising the major part of said panel, (c) at least some of said cavities being provided with acoustical absorptive material in engagement with the entire transverse extent of the flat sections thereof.

10. A sound barrier in accordance with claim 9, wherein said panel is transparent and wherein portions of at least some cavities are free of said acoustical absorptive material whereby to provide undistorted vision from one side of said panel to the opposite side thereof through said portions.

11. A sound barrier in accordance with claim 9 or 10, wherein said acoustical absorptive material has its exposed surface covered with a plastic film which defines a protective membrane therefor.

12. A sound barrier in accordance with claim 9 or 10, wherein said acoustical absorptive material fills at least half but less than all of the cavity so as to be recessed therewithin.

13. A sound barrier in accordance with claim 12, wherein the juncture of the acoustical absorptive material and the associated ribs is defined by an obtuse angle facilitating the cleaning of such juncture.

* * * * *